US005243924A

United States Patent [19]

Mann

[11] Patent Number: 5,243,924

[45] Date of Patent: Sep. 14, 1993

[54] AMPHIBIOUS MULTIHULL BOAT

[76] Inventor: Harold J. Mann, 6180 Sea Isle, Galveston, Tex. 77554

[21] Appl. No.: 803,208

[22] Filed: Dec. 6, 1991

[51] Int. Cl.[5] ..... B63C 13/00

[52] U.S. Cl. ..... 114/61; 114/344; 114/354; 114/364

[58] Field of Search ..... 114/61, 123, 344, 270, 114/39.1, 354, 364

[56] References Cited

U.S. PATENT DOCUMENTS

| | | | |
|---|---|---|---|
| 2,890,466 | 6/1959 | Bly | 114/344 |
| 3,193,851 | 7/1965 | Fiebelkorn | 114/61 |
| 3,689,950 | 9/1972 | Jalowiecki et al. | 114/344 |
| 3,796,175 | 3/1974 | Ford | 114/61 |
| 3,941,074 | 3/1976 | Millerbernd | 114/270 |
| 4,198,918 | 4/1980 | Patriarca et al. | 114/183 R |

*Primary Examiner*—Jesus D. Sotelo
*Assistant Examiner*—Stephen P. Avila
*Attorney, Agent, or Firm*—Harrison & Egbert

[57] ABSTRACT

A boat including a main hull, a first pontoon hingedly connected to the main hull, and a second pontoon hingedly connected to the main hull on an opposite side of the main hull from the first pontoon. The first and second pontoons have wheels extending outwardly beyond a surface of the first and second pontoons. The first pontoon is selectively movable between a first position extending outwardly of the main hull and a second position extending below the main hull. The first wheel extends below the first pontoon when in the second position. The second pontoon is also selectively movable between a first position extending outwardly from the main hull and a second position extending below the main hull. The second wheel extends below the second pontoon when in the second position. A first strut section extends between the main hull and the first pontoon. A second strut section extends between the main hull and the second pontoon. The strut sections include deck surfaces extending across the boat. A bowsprit is hingedly connected to a forward area of the main hull and is movable between a position above the main hull to a towing position below the main hull.

19 Claims, 7 Drawing Sheets

AMPHIBIOUS MULTIHULL BOAT

TECHNICAL FIELD

The present invention relates to boats. More particularly, the present invention relates to multihull boats which are adaptable between a road worthy and a sea worthy condition.

BACKGROUND ART

As the amount of leisure time increases, more and more people are turning to water sports as a desirable form of recreational activity. The attraction of water skiing, fishing and general boating has stimulated the market for small boats to all-time highs. However, the financial and logistical problems of storing and maintaining a boat are sometimes too great for the average family. If the boat is adapted to be docked in the water, then the cost for dock space, especially in the more congested areas, is increasingly prohibitive. On the other hand, transporting the boat over land from its storage space to the water by means of a trailer necessitates, of course, the purchase of a trailer. It also involves the problems inherent in detaching the boat from the trailer prior to lowering it into the water as well as the problems in remounting it onto the trailer.

Many people own beachfront property in which dock space is not readily available. In order to take advantage of the nearby water, the owners of beachfront properties must store boats, such as catamarans and trimarans, in their garages. It is a complicated procedure to drag the boat over the beach so as to get it into the water. Many times, the complexities of bringing the boat to the water discourage people from enjoying the water activities.

In the past, various U.S. patents have issued related to the need for an easily transportable boat. S. P. Bouchard U.S. Pat. No. 2,850,747, issued on Sep. 9, 1958, provides an amphibious catamaran in which the floats are arranged so as to move, hydraulically or manually, from a position outwardly of the body to a position in which the floats are mounted beneath the body. B. C. Stockmann U.S. Pat. No. 3,114,157, issued on Dec. 17, 1963, shows a raft having retractable wheels fastened thereto so as to enable the raft to be trailed behind a vehicle. N. J. Carroll, Jr. U.S. Pat. No. 3,599,256, issued on Aug. 17, 1971, shows a pair of corresponding running gear assemblies which are detachably mounted in a boat so as to enable the boat to be trailed by a draft vehicle. The running gear assemblies are readily retractable to positions above the water line. J. F. Taylor U.S. Pat. No. 3,787,910, issued on Jan. 29, 1974, discloses an amphibious vehicle in which a central section has expandable wing sections disposed on each side. Each of the wing sections has a retractable wheel assembly incorporated therein. A retractable towbar is provided on the front of the body which enables the towhitch to be moved inwardly relative to the body when the amphibious vehicle is used as a watercraft.

W. J. Brady U.S. Pat. No. 3,797,056, issued on Mar. 19, 1974, describes an amphibious vehicle having a body and a pontoon/wheel assembly on each side pivotally connected to the body for angular movement about an axis parallel to the length of the body between a land traveling position in which the wheels are engagable with the ground and the pontoons are in a laterally inner position and a water travelling position in which the pontoons are in a laterally outward position. U.S. Pat. No. 3,877,094, issued on Apr. 15, 1975, provides a combination trailer and pontoon boat in which the pontoons are hinged to the frame at the junctures between the notches and the flat bottom portions of the frame in a manner so as to fold beneath the flat bottom pontoons of the frame. I. Lindsay U.S. Pat. No. 3,937,166, issued on Feb. 10, 1976, illustrates a multi-hulled boat having a main float and retractable floats normally arranged in spaced apart side-by-side relationship.

It is an object of the present invention to provide a relatively light beach-launching trimaran.

It is another object of the present invention to provide an amphibious vehicle which can be moved between the various positions by human muscle power and leverage.

It is another object of the present invention to provide an amphibious vehicle which can be quickly assembled between its water-going and road-going positions.

It is a further object of the present invention to provide an amphibious vehicle which is relatively inexpensive, easy to manufacture, and easy to use.

These and other objects and advantages of the present invention will become apparent from a reading of the attached specification and appended claims.

SUMMARY OF THE INVENTION

The present invention is a boat comprising a main hull, a first pontoon hingedly connected to the main hull, and a second pontoon hingedly connected to an opposite side of the main hull. The first pontoon has a first wheel which extends outwardly beyond a surface of the first pontoon. The first pontoon is selectively movable between a first position extending laterally outwardly from the main hull and a second position extending to a position below the main hull. The wheel extends below the pontoon when the pontoon is in its second position.

The second pontoon has a second wheel which extends outwardly beyond a surface of the second pontoon. This second pontoon is selectively movable between a first position extending laterally outwardly from the main hull and a second position extending below the main hull. The second wheel extends below the second pontoon when it is in its second position. The first wheel is generally aligned with the second wheel when the pontoons are in their second positions.

A first strut section extends between the main hull and the first pontoon so as to cause the hinged relationship between the main hull and the first pontoon. A second strut section extends between the main hull and the second pontoon so as to create the hinged relationship between the the main hull and the second pontoon. The first strut section forms a first deck surface extending across the main hull and the first pontoon. The second strut section forms a second deck surface extending between the second pontoon and the main hull.

The present invention includes a bowsprit which is hingedly connected to a forward area of the main hull and extends outwardly therefrom. This bowsprit is movable between a first position above the main hull and a second position below the main hull. The bowsprit has a towhitch formed on an end which is suitable for engagement with a transport vehicle when the bowsprit is in the second position.

The wheels can be in fixed positions extending outwardly from the pontoon or they can be in a retractable condition. In a retractable condition, the present invention includes a first frame which extends within the first pontoon in pivotable relationship with a first strut. The first frame is in resilient relationship with a second strut. The first frame is movable between a first position in which the wheel is contained within the pontoon and a second position in which the wheel has a portion extending outwardly from the pontoon. A handle is rotatably connected to the second strut and has a spring fixedly attached to an end thereof. The frame has a receiving plate attached adjacent to the second strut. The handle is movable between a position in which the spring is removed from the receiving plate and a position in which the spring resiliently engages the receiving plate.

A wheel port cover is hingedly connected to the pontoon and is movable so as to seal the interior of the pontoon when the wheel is in its first position. A check valve communicates with an interior of the pontoons so as to enable water to flow unidirectionally from the interior of the pontoons. A stabilizer bar is attached to each of the ends of the pontoons.

DETAILED DESCRIPTION OF THE INVENTION

Figure 1:
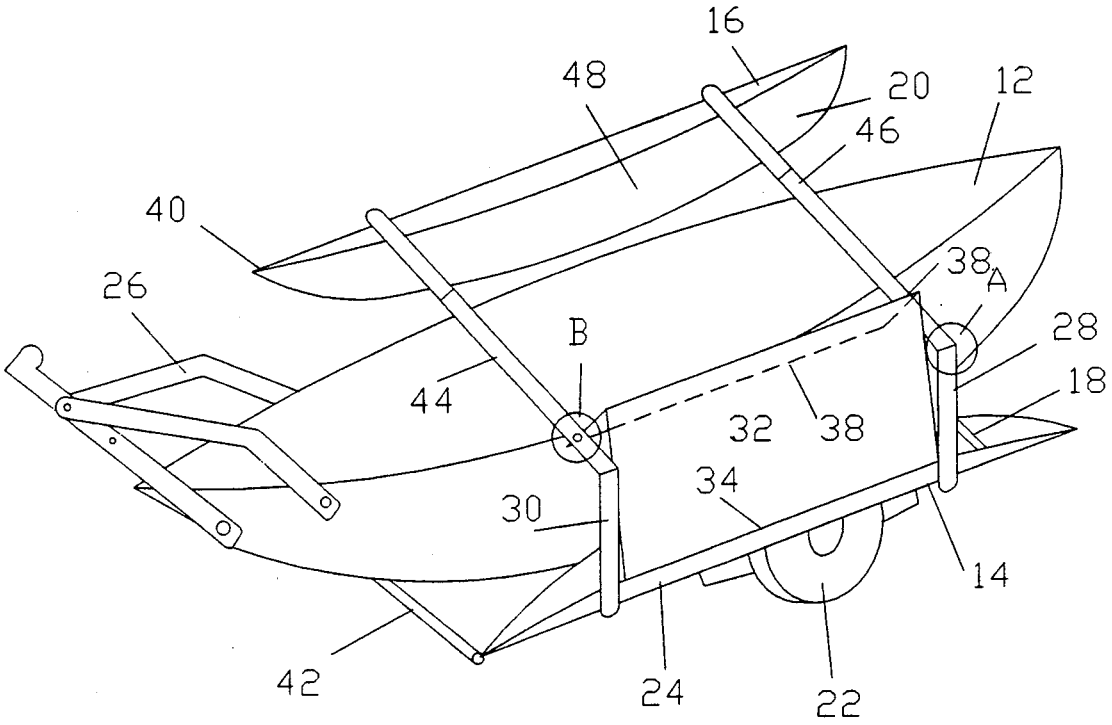
FIG. 1 is a perspective view of the preferred embodiment of the present invention.

Referring to FIG. 1, there is shown at 10 the amphibious multihull boat in accordance with the preferred embodiment of the present invention. Boat 10 comprises a main hull 12, a first pontoon 14, and a second pontoon 16. A first strut section 18 extends between the main hull 12 and the first pontoon 14. A second strut section 20 extends between the second pontoon 16 and the main hull 12.

The first pontoon 14 is a buoyant pontoon suitable for floating on water. Generally, the interior of pontoons 14 and 16 are empty or they can be filled with a buoyant foam. The embodiment of the present invention incorporates the use of wheels 22 within the interior of the pontoons 14 and 16 so as to allow the boat 10 to float on water and to travel on roads or on beaches.

The first pontoon 14 is hingedly connected to the main hull 12 through the use of the special strut section 18. Each of the pontoons 14 and 16 are movable between a first position which extends outwardly laterally from the main hull 12 (as shown by the relationship of the second pontoon 16 with the main hull 12) to a position extending below the main hull 12 (as illustrated by the position of the first pontoon 14 in relation to hull 12). As can be seen, the first pontoon 14 has a wheel 22 extending below the bottom edge 24 of pontoon 14. The second pontoon 16 has a configuration similar to that of the first pontoon 14. When the second pontoon 16 is in a position resembling that of the first pontoon 14 (of FIG. 1), then the wheel of the second pontoon 16 will be generally aligned with the position of the wheel 22 of the first pontoon 14.

It can be seen that the main hull 12 is a floating boat-like apparatus which includes a bowsprit 26 extending outwardly from its forward end. Bowsprit 26 is described in greater detail in connection with FIG. 7. The bowsprit in its upward position is used to join with the forward edge of a sail.

FIG. 1 also illustrates, generally, the arrangement of the first strut section 18 and the second strut section 20. As can be seen, the first strut section 18 extends from the main hull 12 and is joined to the first pontoon 14. It can be seen that the first strut member 28 and the second strut member 30 are foldable so as to cause the hinged relationship of the first pontoon 14 with the main hull 12. A special foldable deck surface 32 is connected along edge 34 to the first pontoon 14. Another edge 36 is connected to the main hull 12. The deck surface 32 folds along fold 38 so as to assist in the movement of the pontoon from its outward lateral position to the position illustrated in FIG. 1. The forward edge of the first pontoon 14 is joined to the bowsprit 26 by the use of a stabilizer bar 42. Stabilizer bar 42 secures the pontoon in its retracted position so that the pontoon can more easily travel along a road or beach surface. The stabilizer bar 42 fixes the pontoons in position relative to the bowsprit 26 when the bowsprit is in its lowered position for engaging a towhitch (to be described hereinafter).

FIG. 1 also shows the second strut section 20 as including a first strut 44 and a second strut 46. Each of the struts 44 and 46 extend straight out laterally from the main hull 12. A generally flat deck surface 48 extends from the second pontoon 16 to the main hull 12.

Figure 2:
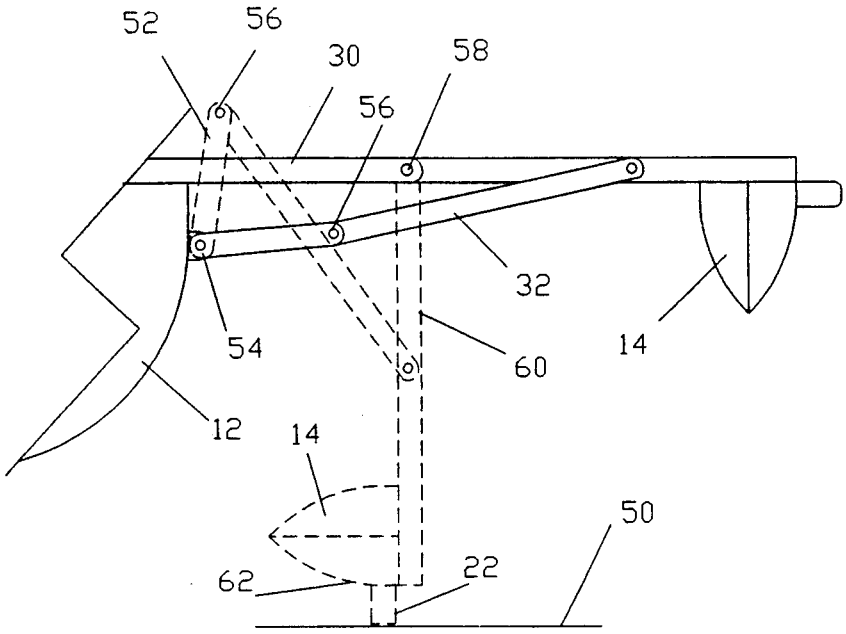
FIG. 2 is a frontal view showing the pontoon of the present invention and, in particular, its movement between a retracted and extended position.

FIG. 2 illustrates how the first pontoon 14 is retracted into its road-engaging position. Initially, in FIG. 2, it can be seen that the first pontoon 14 extends laterally outwardly from the main hull 12. Strut 30 extends in a straight configuration between the hull 12 and the pontoon 14. Deck surface 32 is similarly looked in position to both support the strut 30 and to maintain the pontoon 14 in its outward position.

In order to place the first pontoon 14 into a position so as to allow it to roll along road 50, the deck 32 is pulled upwardly such that deck section 52 pivots at its joint 54 with hull 12 and also pivots about joint 56. The strut 30 will similarly pivot at joint 58 such that a strut portion 60 extending vertically downwardly from this joint 58. As will be described hereinafter, as the pontoon 14 moves from its flotation position to its road-engaging position, wheel 22 will extend outwardly from the pontoon 14 along surface 62. In this configuration, the wheel 22 will support the main hull 12 above the road surface 50.

Figure 3:
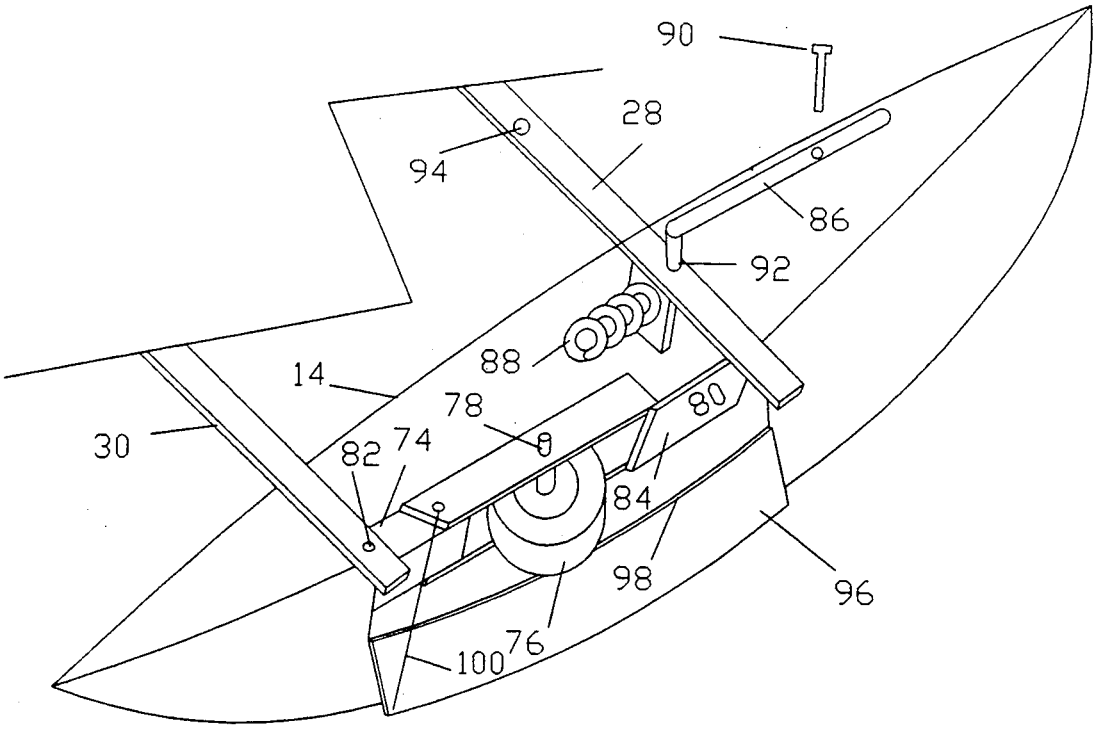
FIG. 3 is an interior view of the wheel mechanism within the interior of a pontoon.

FIG. 3 illustrates how the wheel assembly 70 is retained within the interior 72 of the first pontoon 14. The wheel assembly 70 includes a frame 74 which is pivotally connected to the strut member 30. As can be seen, the frame 74 rotatably supports wheel 76 along axle 78. Wheel 76 can be a pneumatic tire. A plate 80 is fastened to frame 74 at the end of frame 74 opposite the pivotal connection 82 with the strut 30. Plate 80 provides a spring-receiving surface 84. The other strut member 28 extends into the pontoon 14 in generally close proximity to the plate 80. The strut member 28 receives a handle 86 which is rotatably connected thereto. Handle 86 has a spring 88 attached at one end. Handle 86 has a pin 90 removably attached thereto. As shown in FIG. 3, the pin 90 secures the handle in its position against the pontoon 14. When it is necessary for the pontoon 14 to assume its road-engaging position, the handle 86 is suitable for rotating about point 92 so as to move from the position engaging the pontoon 14 to a position engaging the strut member 28. Pin 90 will work so as to secure handle 86 to strut 28 at point 94. The rotation of the handle 86 will cause the spring 88 to be placed into resilient contact with the top surface 84 of spring receiving plate 80.

It can further be seen in FIG. 3 that a wheel port cover 96 is in hinged relationship at 98 to the first pontoon 14. A line 100 connects the cover 96 to the frame 74. Ideally, as the wheel assembly 70 is retracted into the interior of pontoon 14, line 100 will cause a closing of the cover 96 so as to properly seal the interior of pontoon 14. When it is necessary to cause the pontoon 14 to assume its road-engaging position, the surface of the wheel 76 will press against the cover 96 so as to open the cover and allow the wheel 76 to exit through the port.

Figure 4:
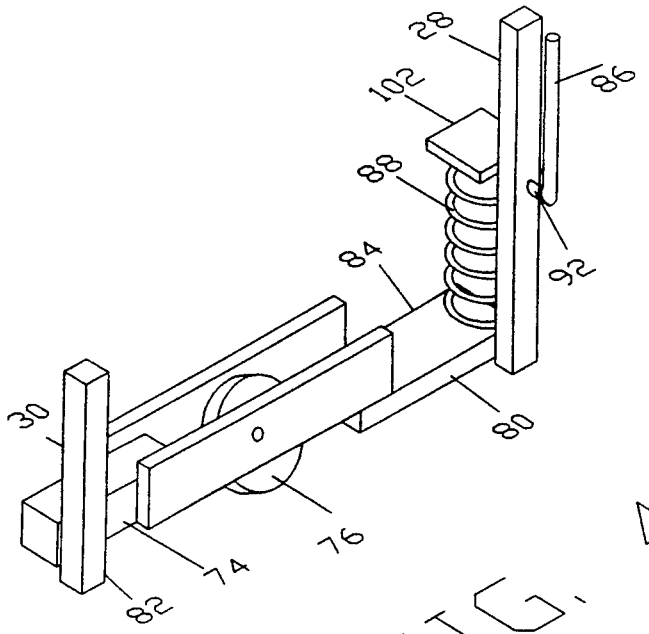
FIG. 4 is a perspective view of the wheel assembly in its extended position, as illustrated in FIG. 1.

FIG. 4 illustrates the wheel assembly 70 in its outward road-engaging configuration. It can be seen that the frame 74 pivots in relation to the strut member 30 so as to cause the wheel 76 to move angularly outwardly. This movement is accomplished by rotating handle 86 about point 92 on strut member 28. It can be seen that the spring 88 is fastened to member 102 which is affixed to the end 104 of handle 86. The rotation of the handle 86 from the position of FIG. 3 to the position of FIG. 4 causes the spring 88 to engage the surface 84 of plate 80. This causes the angular movement about pivot point 82 on strut member 30. The plate 80 will generally slide along a surface of strut member 28 until the wheel 76 extends outwardly from the pontoon 14. Spring 86 will provide the necessary support for the assembly during the traversing of a road surface. In essence, the spring 88 will perform a similar function as a shock absorber.

Figure 5:
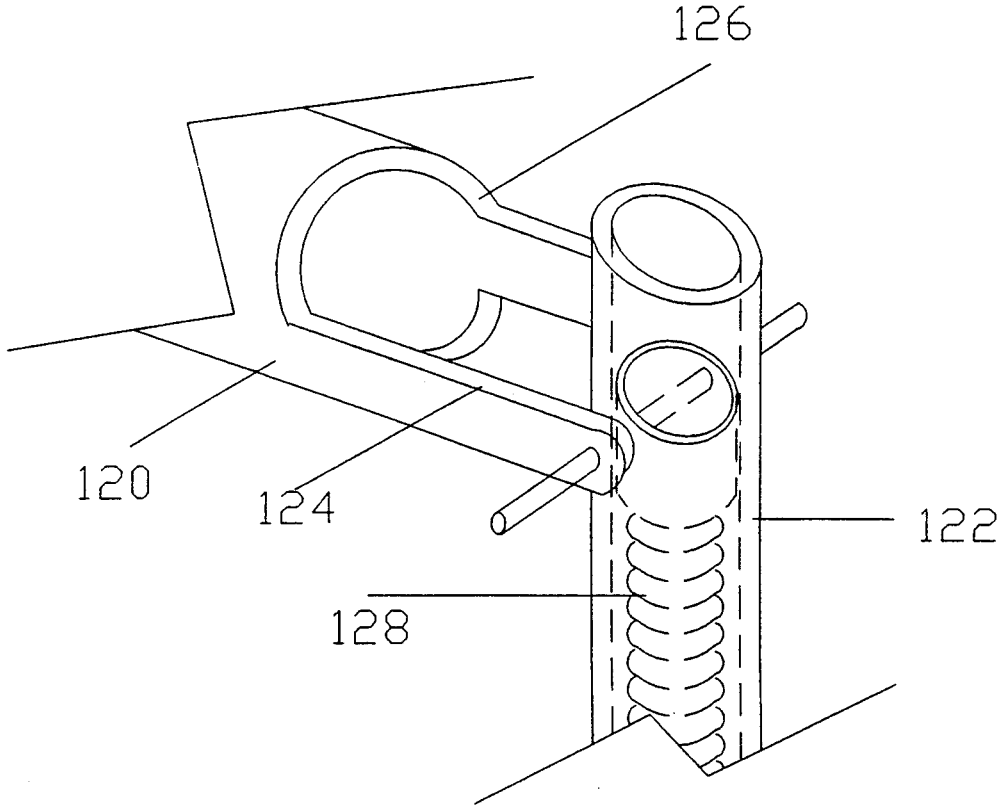
FIG. 5 is a detailed view of circled area A of FIG. 1.

FIG. 5 shows a detailed view of the circled area A on strut 28. It can be seen that the first strut portion 120 is pivotally connected to the second strut portion 22. In particular, tongues 124 and 126 extend outwardly from the strut portion 120. A spring 128 is provided interior of the second strut portion 122 so as to provide a suitable initial compression so as to cause the strut to remain in place. The configuration shown in FIG. 5 is desirable when the wheel 22 is affixed in position within pontoon 14. The spring 128 acts as a shock absorber during movement of the pontoons on a road or other surface.

Figure 6:
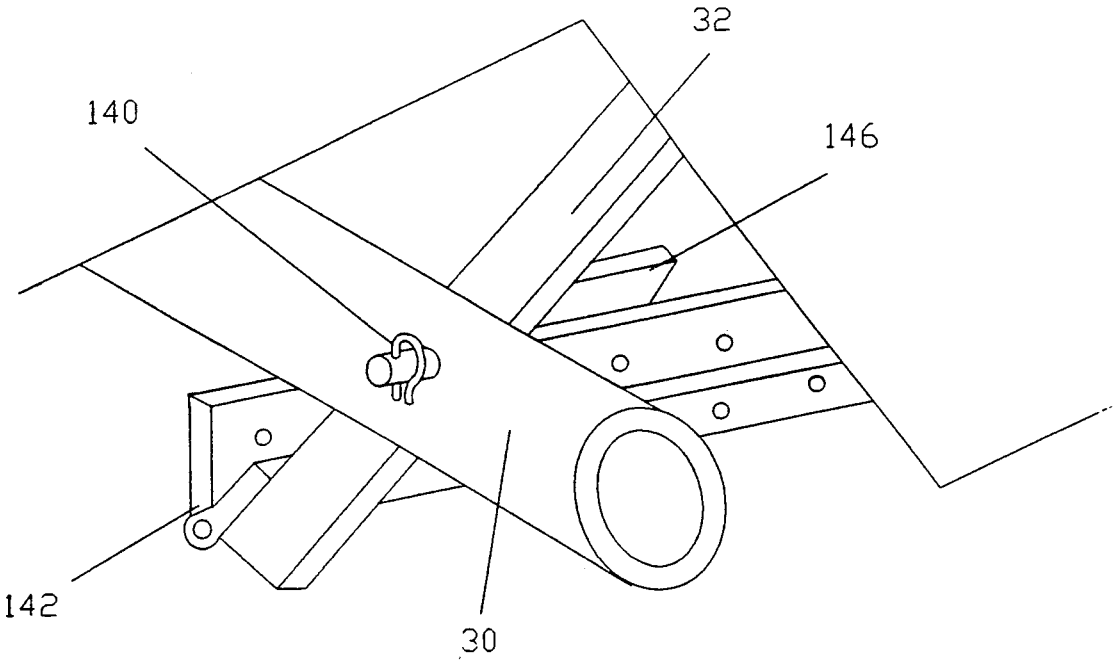
FIG. 6 is a detailed view of circled area B in FIG. 1.

FIG. 6 is a detailed view of circled area B of FIG. 1. In particular, it can be seen how the deck surface 32 is interconnected with the struts and to the hull. Initially, it can be seen that the deck surface 32 is pivotally connected at 140 to the strut 30. A piano hinge 142 is provided on the port side hull 144 so as to receive the edge of the deck surface 32. A reinforcement plate 146 is provided so as to secure the integrity of the pivotal connection between the deck surface 32 and the strut member 30.

Figure 7:
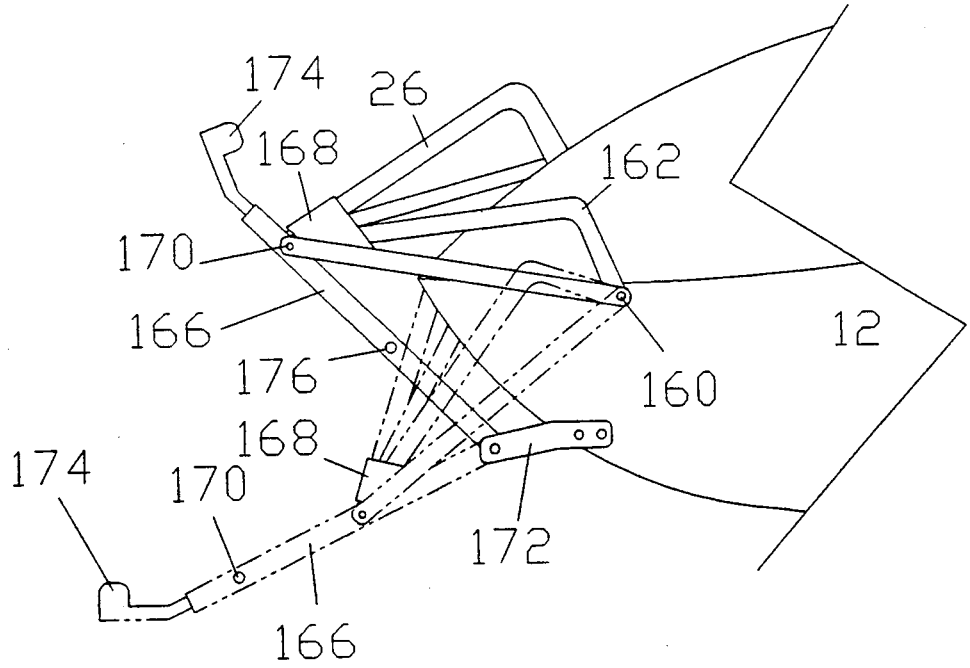
FIG. 7 is a perspective view showing the movement of the bowsprit in accordance with the present invention.

FIG. 7 illustrates how the bowsprit 26 interacts with the system of the present invention so as to facilitate the use of the boat 10 as an amphibious vehicle. Initially, the bowsprit 26 and pulpit are rotatably connected to the hull 12 by bolts 160. The tubing 162 and 164 of the pulpit extends outwardly from the bolt 160 and is joined to the main bowsprit member 166. The pulpit tubing 162 and 164 are joined by bracket 168 with the main member 166. A pin 170 is inserted through the hole in the main member 166 so as to secure the main bowsprit member 166 in the upright position as illustrated in solid line in FIG. 7. Tho main bowsprit member 166 rotates about joint 172. The main bowsprit member 166 includes a towhitch 174 at its end opposite the hull 12. Towhitch 174 is suitable for joining to a towing vehicle. When it is necessary to lower the main bowsprit member 166, the pin is removed from hole 170 so that the bracket 168 will slide along the exterior of the main bowsprit member 166 until it reaches bolt hole 176. When it reaches that position, then the pin is reinserted into and through the hole so as to secure the bracket 168 in that position. This will cause the main bowsprit member 166 and pulpit to lower into the dotted line position illustrated in FIG. 7. The towhitch 174 will be in suitable position to join a vehicle. In its upward position, the bowsprit 26 can be used to join with the forward edge of a sail. As such, the bowsprit will include means, such as a fitting, for fastening to the forward edge of a sail.

Figure 8:
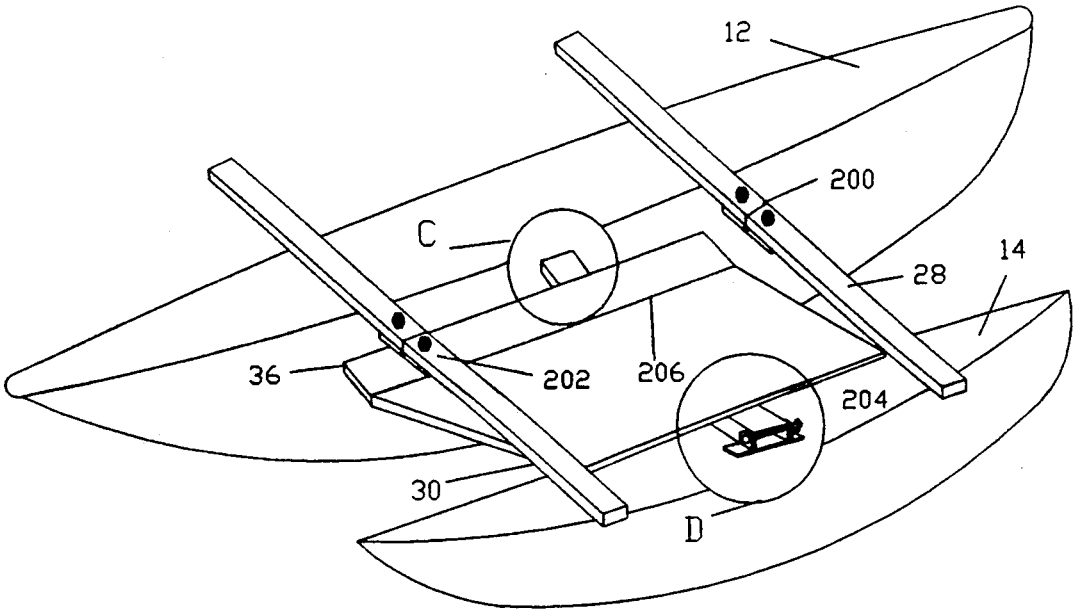
FIG. 8 is a perspective view of the strut/deck assembly of of the present invention.

In FIG. 8, it can be seen how the first strut assembly 18 functions to join the first pontoon 14 with the main hull 12. Strut members 28 and 30 extend horizontally across the top surface of the main hull 12 and the pontoon 14. A suitable pin at 200 serves to lock the strut member 28 in its horizontal position. Similarly, a pin 202 can be used to look the second strut member 30 in its horizontal position. Deck surface 32 extends from its connection at edge 34 with the first pontoon 14 to its connection at 36 with the main hull 12. Importantly, it can be seen that a deck lever 204 extends across the surface of deck 32 so as to act as a brace and to cooperate with the deck surface. It can further be seen that the deck surface 32 and the deck lever 204 pivot along line 206.

Figure 9:
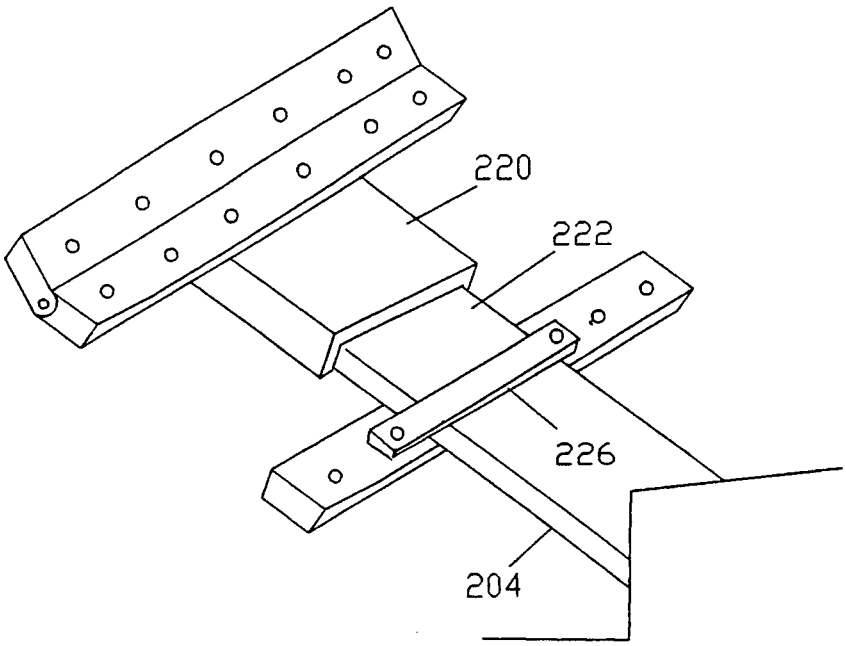
FIG. 9 is a detailed view of circled area C of FIG. 8.

FIG. 9 shows the circled area C of FIG. 8. FIG. 9 shows, in particular, the arrangement of the deck lever 204. At one end, a locator box 220 is joined to hull 12 so as to bolt to the piano hinge 222 of deck lever 204. Deck section 224 is supported by the deck lever 204. In particular, the deck section 224 is strap bolted at 226 to the piano hinge.

Figure 10:
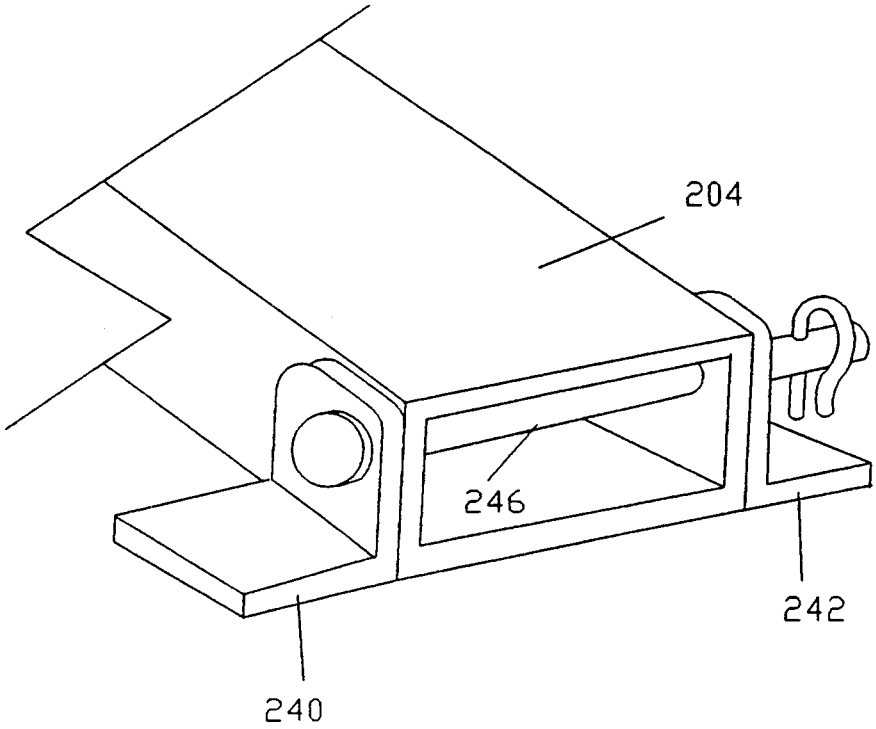
FIG. 10 is a detailed view of circled area D of FIG. 8.

FIG. 10 illustrates the circled area D of FIG. 8. In particular, it can be seen that the deck lever 204 is joined to angle clips 240 and 242. Angle clips 240 and 242 are suitably bolted, screwed, or otherwise attached to the top surface 244 of the first pontoon 14. It can be seen that the deck lever 204 is free to rotate about pivot axis 246.

Figure 11:
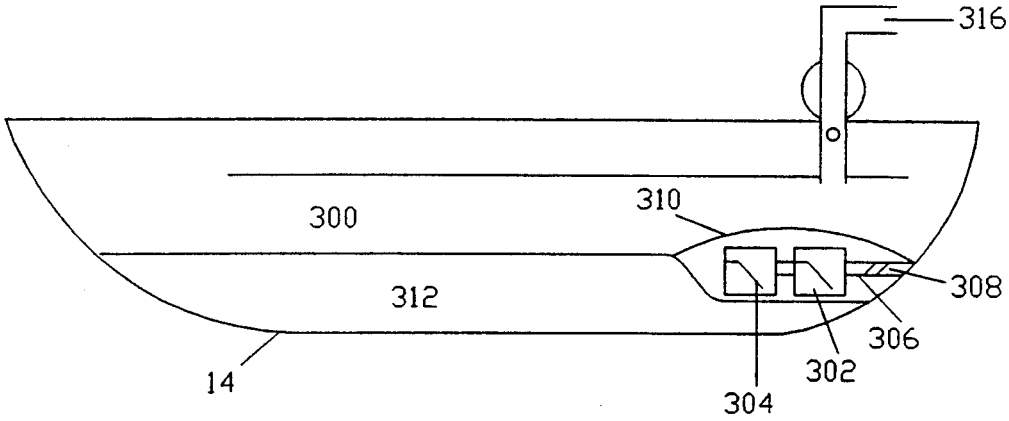
FIG. 11 is a cross-sectional view showing the check valves of a pontoon of the present invention.

FIG. 11 shows a cross-sectional view of the interior of pontoon 14. In FIG. 11, it is significant to note that a mechanism is provided for the removal of an water that might accumulate on the interior 300 of pontoon 14. This mechanism includes a first check valve 302 and a second check valve 304. A pipe 306 connects the check valve 302 and 304 with the exterior of the pontoon 14. Any water accumulation within the interior 300 of pontoon 14 is allowed to pass outwardly through pipe 306 to the exterior. Suitable screens 308 are provide within pipe 306 so as to filter material and to prevent the fouling of the check valves 302 and 304. In addition, a domed intake scree 310 is provided to further filter materials from following the check valves. The interior of the pontoon 14 is enhanced by the use of buoyancy foam 312. Vent perforations 314 and 316 are provided, if necessary, so as to allow the interior of the pontoon 14 to be properly ventilated.

Figure 12:
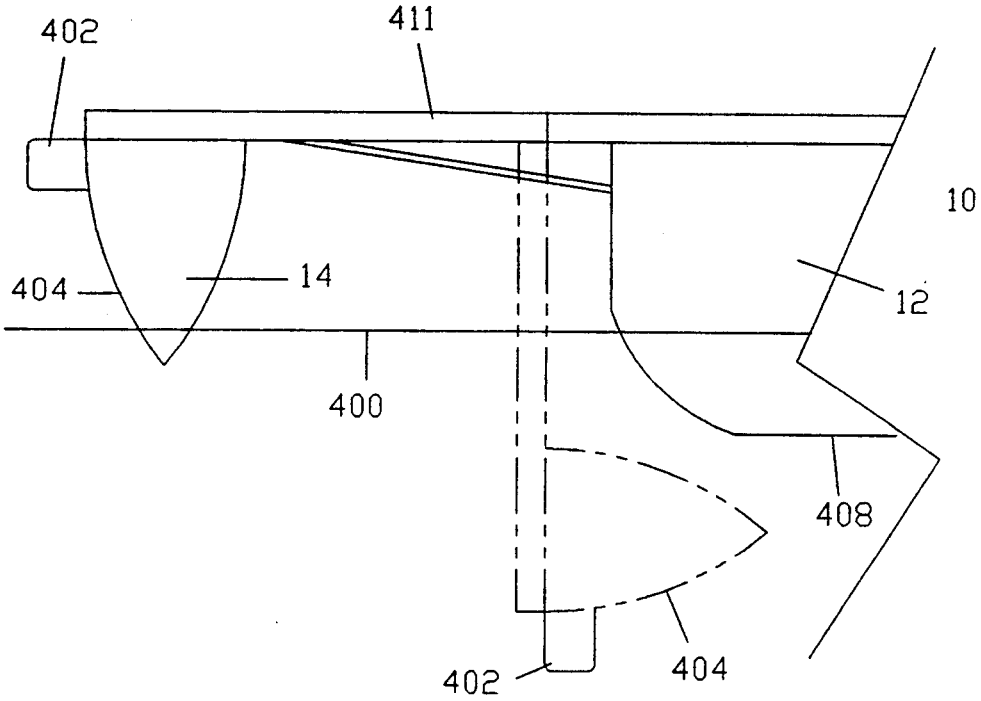
FIG. 12 is an illustration of the operation of the present invention and also shows an alternative embodiment of the present invention.

FIG. 12 illustrates the operation of the present invention. It can be seen that the main hull 12 and the first pontoon 14 are floating along the surface 400 of a body of water. FIG. 12 also illustrates an alternative form of the present invention in which the wheel 402 is fixedly extended beyond the outer surface 404 of pontoon 14 during flotation. However, the description of the operation of the present invention can be described in the same manner whether the wheel 402 extends outwardly or is retained inwardly of the pontoon 14. The deck section 409 extends outwardly from the pontoon 14 in hinged relationship to the strut section 411.

When it is necessary to remove the boat 10 from the water 400, suitable pins are removed so that the pontoon 14 can fill with water and move into the position illustrated by dotted lines 406. By flooding the interior of pontoon 14, the pontoon 14 will assume a position beneath the bottom 408 of hull 12. The wheel 402 will extend outwardly beyond the bottom surface of the pontoon 14. In this position, the wheel 402 is suitable for rollably engaging a surface. With the other pontoon in a similar position, the boat 10 is suitable for removal from the water. After the boat 12 is removed from the water, the flooded pontoons 14 will drain. The deck section 409 pivots relative to the strut section 411 so as to assume a position below the main hull 12 adjacent to an inner surface of pontoon 406.

The foregoing disclosure and description of the invention is illustrative and explanatory thereof. Various details in the construction of the illustrated apparatus may be made within the scope of the appended claims without departing from the true spirit of the invention. The present invention should only be limited by the following claims and their legal equivalents.

I claim:

1. A boat comprising:

a main hull;

a first pontoon hingedly connected to said main hull, said first pontoon having a first wheel extending beyond a surface of said first pontoon, said first pontoon selectively movable between a position extending outwardly of said main hull and a second position extending below said main hull, said first wheel extending below said first pontoon when in said second position;

a second pontoon hingedly connected to said main hull, said second pontoon having a second wheel extending outwardly beyond a surface of said second pontoon, said second pontoon selectively movable between a first position extending outwardly from an opposite side of said main hull from said first pontoon and a second position extending below said main hull, said second wheel extending below said second pontoon when in said second position, said first wheel generally aligned with said second wheel in said second position; and a first strut section extending between said main hull and said first pontoon, said first strut section foldable so as to hinge said main hull with said first pontoon, said first strut section having a first deck surface extending between said first pontoon and said main hull, said first strut section having a joint positioned between said pontoon and said main hull, said joint defining a fold line along said first deck surface such that one portion of said first deck surface is pivotable with respect to another portion of said first deck surface, said fold line extending distal of and parallel to said main hull.

2. The boat of claim 1, further comprising:

a second strut section extending between said main hull and said second pontoon, said second strut section foldable so as to hinge said main hull to said second pontoon.

3. The boat of claim 2, said second strut section comprising a second deck surface extending between said second pontoon and said main hull.

4. The boat of claim 1, further comprising:

a bowsprit hingedly connected to a forward area of said main hull and extending outwardly therefrom, said bowsprit movable between a first position above said main hull and a second position below said main hull.

5. The boat of claim 4, said bowsprit having a towhitch formed on an end thereof, said towhitch suitable for engagement with a transport vehicle when said bowsprit is in said second position.

6. The boat of claim 1, said first wheel in a fixed position extending outwardly of said first pontoon, said second wheel in a fixed position extending outwardly of said second pontoon, each of said first and second pontoons having buoyancy means contained therein for enabling said first and second pontoons to float on water.

7. The boat of claim 2, further comprising:

a first frame extending within said first pontoon in pivotable relationship with a first strut member of said first strut section, said first frame rotatably supporting said first wheel thereon, said first frame in resilient relationship with a second strut member of said first strut section.

8. The boat of claim 7, said first frame movable between a first position in which said first wheel is contained within said first pontoon and a second position in which said first wheel has a portion extending outwardly from said first pontoon, said first frame movable relative to said second strut member between said first and second positions.

9. The boat of claim 8, further comprising:

a handle selectively rotatably connected to said second strut member, said handle having a spring fixedly attached thereto at one end, said frame having a receiving plate attached thereto adjacent said second strut member, said handle movable between a position in which said spring is removed from said receiving plate and another position in which said spring engages said receiving plate.

10. The boat of claim 8, further comprising:

a wheel port cover hingedly connected to said first pontoon, said wheel port cover movable so as to seal the interior of said first pontoon when said first wheel is in said first position.

11. The boat of claim 1, further comprising:

a check valve communicating with an interior of said first pontoon so as to enable water to pass unidirectionally from the interior of said first pontoon.

12. The boat of claim 4, further comprising:

a stabilizer bar attached at one end to a forward end of said first pontoon and attached at another end to said bowsprit.

13. A boat comprising:

a main hull;

wheel means interconnected to said main hull for supporting said main hull above a surface;

a bowsprit hingedly connected to a forward area of said main hull and extending outwardly therefrom, said bowsprit movable between a first position above said main hull and a second position below said main hull; and a pulpit rotatably connected to said main hull at one end and joined to said bowsprit at another end, said pulpit extending above said main hull when said bowsprit is in said first position.

14. The boat of claim 13, said bowsprit having a towhitch formed on an end thereof, said towhitch suitable for engagement with a transport vehicle when said bowsprit is in said second position, said bowsprit having means thereon for attachment to a said.

15. The boat of claim 13, said wheel means comprising:

a first pontoon hingedly connected to said main hull, said first pontoon having a first wheel extending outwardly beyond a surface of said first pontoon, said first pontoon selectively movable between a first position extending outwardly of said main hull and a second position extending below said main hull, said first wheel extending below said first pontoon when in said second position; and a second pontoon hingedly connected to said main hull, said second pontoon having a second wheel extendable outwardly beyond a surface of said second pontoon, said second pontoon selectively movable between a first position extending outwardly from an opposite side of said main hull from said first pontoon and a second position extending below said main hull, said second wheel extending below said second pontoon when in said second position, said first wheel generally aligned with said second wheel in said second position.

16. The boat of claim 15, further comprising:

a first strut section extending between said main hull and said first pontoon, said first strut section foldable so as to hinge said first pontoon to said main hull; and a second strut section extending between said main hull and said second pontoon, said second strut section foldable so as to hinge said main hull to said second pontoon.

17. A boat comprising:

a main hull;

a first pontoon hingedly connected to said main hull, said first pontoon having a wheel extending outwardly beyond a surface of said first pontoon, said first pontoon selectively movable between a first position extending outwardly of said main hull and a second position extending below said main hull, said first wheel extending below said first pontoon when in said second position;

a first strut section extending between said main hull and said first pontoon so as to cause said first pontoon to hinge with respect to said main hull, said first strut section comprising a first deck surface extending between said first pontoon and said main hull;

a second pontoon hingedly connected to said main hull, said second pontoon having a second wheel extending outwardly beyond a surface of said second pontoon, said second pontoon selectively movable between a first position extending outwardly from an opposite side of said main hull from aid first pontoon and a second position extending below said main hull, said second wheel extending below said second pontoon when in said second position, said first wheel generally aligned with said second wheel in said second position;

a second strut section extending between said main hull and said pontoon so as to hinge said second pontoon with respect to said main hull, said second strut section comprising a second deck surface extending between said second pontoon and said main hull a wheel port cover hingedly connected to said first pontoon, said wheel port cover movable so as to seal the interior of said first pontoon when said first wheel is in said first position, the movement of said wheel from said first position to said second position causing said wheel port cover to open from said first pontoon; and a check valve communicating with an interior of said first pontoon so as to enable water to pass unidirectionally from the interior of said first pontoon.

18. The boat of claim 17, comprising:

a first frame extending in said first pontoon in pivotal relationship with a first strut member of said first strut section, said first frame rotatably supporting said first wheel thereon, said first frame in resilient relationship with a second strut member of said first strut section.

19. The boat of claim 18, said first frame movable between a first position in which said first wheel is contained within said first pontoon and a second position in which said first wheel has a portion extending outwardly from said first pontoon, said first frame movable relative to said second strut member between said first and second positions.

* * * * *